US010927612B2

(12) United States Patent
Zeng et al.

(10) Patent No.: US 10,927,612 B2
(45) Date of Patent: Feb. 23, 2021

(54) DOWNHOLE AUXILIARY DRILLING APPARATUS

(71) Applicants: CHINA PETROLEUM & CHEMICAL CORPORATION, Beijing (CN); SINOPEC RESEARCH INSTITUTE OF PETROLEUM ENGINEERING, Beijing (CN)

(72) Inventors: Yijin Zeng, Beijing (CN); Qunai Hu, Beijing (CN); Chenxi Zhao, Beijing (CN); Xiaojie Cui, Beijing (CN); Jianjun Zhao, Beijing (CN); Lanrong Ma, Beijing (CN); Guangming Cheng, Beijing (CN); Lianzhong Sun, Beijing (CN); Naihe Hou, Beijing (CN)

(73) Assignees: CHINA PETROLEUM & CHEMICAL CORPORATION, Beijing (CN); SINOPEC RESEARCH INSTITUTE OF PETROLEUM ENGINEERING, Beijing (CN)

( * ) Notice: Subject to any disclaimer, the term of this patent is extended or adjusted under 35 U.S.C. 154(b) by 0 days.

(21) Appl. No.: 16/373,169

(22) Filed: Apr. 2, 2019

(65) Prior Publication Data

US 2019/0330931 A1 Oct. 31, 2019

(30) Foreign Application Priority Data

Apr. 27, 2018 (CN) ..... 201810391598.X
Apr. 27, 2018 (CN) ..... 201810392282.2

(51) Int. Cl.
*E21B 17/07* (2006.01)
*E21B 4/06* (2006.01)
*E21B 17/10* (2006.01)

(52) U.S. Cl.
CPC ..... *E21B 17/1078* (2013.01); *E21B 17/07* (2013.01)

(58) Field of Classification Search
CPC ..... E21B 4/06; E21B 7/025; E21B 17/07
See application file for complete search history.

(56) References Cited

U.S. PATENT DOCUMENTS 8,720,608 B2 * 5/2014 Downton ..... E21B 4/06 175/293
10,233,695 B2 * 3/2019 Guan ..... E21B 10/62

* cited by examiner

*Primary Examiner* — Catherine Loikith
(74) *Attorney, Agent, or Firm* — Novick, Kim & Lee, PLLC; Allen Xue

(57) ABSTRACT

The present invention provides a downhole auxiliary drilling apparatus, including an impact energy generator capable of converting the energy of the drilling fluid to the axial impact energy, and an impact energy distributor capable of redistributing the impact energy generated by the impact energy generator to convert the axial impact force into a combined impact force, which provides the drilling bit with a high-frequently changing combined impact force, thus greatly improving the rock breaking efficiency and the rate of penetration of the drilling tool. The downhole auxiliary drilling apparatus is further provided with a shock-absorbing and torque-stabilizing device arranged between the impact energy generator and the impact energy distributor, which can reduce the axial vibration of the drilling tool and the damage on the drilling bit, and greatly extend the lifetime of the drilling bit.

17 Claims, 6 Drawing Sheets

DOWNHOLE AUXILIARY DRILLING APPARATUS

CROSS REFERENCE TO RELATED APPLICATIONS

This application claims priority to Chinese Application No. 201810392282.2, filed on Apr. 27, 2018, and Chinese Application No. 201810391598.X, filed on Apr. 27, 2018, which are specifically and entirely incorporated by reference.

TECHNICAL FIELD

The invention relates to the technical field of petroleum industry machinery and drilling technology, in particular to a downhole auxiliary drilling apparatus.

TECHNICAL BACKGROUND

With the continuous development of oil drilling technology, a variety of drilling tools having different functions have been developed to meet the needs of drilling engineering. With the rapid development of technology, the performance of drilling tools in the prior arts has been greatly improved.

However, under some special conditions, there are still some problems. For example, in soft-hard staggered formations or hard formations, harmful vibrations of the downhole drilling bit and the drilling tool are easily generated during the drilling process, due to large lithological changes or high strength of such formations. These harmful vibrations will not only reduce the rock breaking efficiency of the drilling bit, but also cause premature failures of drilling teeth or cutting teeth and the drill tool, thus leading to a series of problems that would affect the drilling cycle and drilling costs, such as slow rate of penetration, short drilling bit lifetime, drilling tool failures (eccentric wear, corrosion leakage, or break-off), downhole junk, or the like.

In addition, the stability and aggressiveness of the drilling bit in the prior arts are difficult to be balanced with each other to some extent. Therefore, in order to improve the stability of the drilling bit, measures to reduce the aggressiveness of the drilling bit, such as increasing the number of drilling flanks, reducing the size of cutting teeth and increasing the density of cutting teeth, are often employed. However, these measures, although improving the lifetime of the PDC bit, reduce the rate of penetration of the bit. To this end, a variety of auxiliary rock breaking tools came into being, and also achieved a certain technical effect. However, these tools were primarily designed to reduce and suppress a single form of downhole vibrations. Since different forms of vibrations are coupled to each other, once the drilling bit is subjected to various vibrations, it is difficult to ensure that the rate of penetration can be effectively improved through a combination of current drilling tool and speed increasing tool.

Therefore, in view of the above problems, there is a need to provide a downhole auxiliary drilling apparatus, which can improve the rock breaking efficiency of the drilling bit.

SUMMARY OF THE INVENTION

In view of the technical problems described above, the present invention is directed to provide a downhole auxiliary drilling apparatus, which is capable of reducing the impact of axial and circumferential downhole vibrations on a drilling bit, so as to prevent damage of the drilling bit. At the same time, the downhole auxiliary drilling apparatus can provide the drilling bit with a high frequently changing impact force in a combined direction. In addition, the downhole auxiliary drilling apparatus can further automatically store and release the overload energy of the drilling bit during the drilling process, thereby effectively increasing the rock breaking ability of the drilling bit, improving the rock breaking efficiency, and solving the problems of the drilling bit when drilling in the hard formation and the interlayer, such as bouncing, slipping, stalling, slow rate of penetration, failure of the drilling tool, or the like.

According to the present invention, a downhole auxiliary drilling apparatus is provided, comprising an impact energy generator, and an impact energy distributor arranged downstream of the impact energy generator. The impact energy generator includes: a cylindrical casing; a hollow drive shaft concentrically arranged in the casing; a valve disc mechanism arranged on the drive shaft, wherein the valve disc mechanism includes a stationary valve disc and a movable valve disc, the movable valve disc being configured to be driven into rotation by the drive shaft so that a flowing area of the valve disc mechanism is periodically changing; and a drilling fluid splitting mechanism arranged between the casing and the drive shaft. The drilling fluid splitting mechanism includes a piston head sealingly disposed on an inner wall of the casing, a flow splitting member disposed inside the piston head, a force transmission sleeve disposed in the casing, and at least one hydraulic motor disposed downstream of the piston head and inside the force transmission sleeve. The flow splitting member is configured to allow a part of drilling fluid flows into an internal passage of the drive shaft directly while the other part of drilling fluid flows into the internal passage via the hydraulic motor, which is configured to drive the drive shaft into rotation through the drilling fluid, and both ends of the force transmission sleeve are fixedly connected to the piston head and the stationary valve disc respectively. The impact energy distributor includes a hollow mandrel, with one end thereof being connected to the stationary valve disc and the other end thereof being connected to a downstream drilling tool; and a compression-torsion housing, which is connected to a downstream end of the casing and forms a helix fit with the mandrel, so as to convert an axial impact force experienced by the mandrel into a combined impact force.

In a preferred embodiment, the flow splitting member is configured as a sleeve member having an end with a radial flange, wherein a circumferential wall of the sleeve member is provided with a plurality of slits, which allows a part of the drilling fluid flows into the hydraulic motor.

In a preferred embodiment, the flow splitting member is secured to an upstream end of the drive shaft, and a converging nozzle is arranged at a position in the drive shaft adjacent to the flow splitting member.

In a preferred embodiment, the hydraulic motor is configured as a turbine section having a stator and a rotor, wherein the rotor is configured to be rotated by means of the drilling fluid, so as to drive the drive shaft into rotation.

In a preferred embodiment, an adjustment ring is provided in the force transmission sleeve at a position downstream of the turbine section, and a channel is arranged in a region of the drive shaft corresponding to the adjustment ring, for guiding the drilling fluid flowing through the turbine section to the internal passage of the drive shaft.

In a preferred embodiment, a plurality of thrust bearings is mounted between the adjustment ring and the movable valve disc.

In a preferred embodiment, an eccentric hole is provided in the movable valve disc, so that the flowing area of the valve disc mechanism is periodically changing.

In a preferred embodiment, the movable valve disc is secured to the drive shaft through a seat member, and mounted on the stationary valve disc via a bearing.

In a preferred embodiment, a cylinder is fixedly connected to an upstream end of the casing through a middle joint, wherein the cylinder is provided therein with a piston, which is fixedly connected to the piston head.

In a preferred embodiment, the middle joint and the piston head together define a closed first annular space between the casing and the piston, wherein a first through hole is formed at a position of a side wall of the piston which is located in the first annular space.

In a preferred embodiment, a closed second annular space is defined by the cylinder, the piston, and the middle joint, wherein a second through hole is formed at a position of a side wall of the cylinder which is located in the second annular space.

In a preferred embodiment, a shock-absorbing and torque-stabilizing device is arranged between the impact energy generator and the impact energy distributor.

In a preferred embodiment, the shock-absorbing and torque-stabilizing device comprises: a spring cylinder, with two ends thereof being secured to the casing and the compression-torsion housing respectively; and a spring inner sleeve arranged in the spring cylinder, with two ends thereof being connected to the stationary valve disc and the mandrel respectively, wherein at least one elastic member is arranged between the spring cylinder and the spring inner sleeve.

In a preferred embodiment, a first limiting member and a second limiting member are arranged at two ends of the elastic member respectively, and the spring inner sleeve is connected to the mandrel via the second limiting member.

In a preferred embodiment, at least one spacer is arranged between the elastic member and the first limiting member and between the elastic member and the second limiting member, for adjusting preload of the elastic member.

In a preferred embodiment, the spring inner sleeve is fixedly connected to the second limiting member, and the mandrel is provided at one end thereof with a mandrel bushing, which is in contact with the second limiting member via a bearing.

In a preferred embodiment, the mandrel is provided with an outer helix, and the compression-torsion housing is provided with an inner helix, which is engageable with the outer helix, and a through hole for injecting lubricant.

The downhole auxiliary drilling apparatus according to the present invention can generate the axial impact energy and the circumferential impact energy through the impact energy generator and the impact energy distributor, thus providing the drilling bit with a high-frequently changing combined impact force, which greatly improves the rock breaking efficiency and the rate of penetration of the drilling tool. When the drill is stalled, the drilling bit can be axially moved through the helical pair of the impact energy distributor, and thus effectively prevented from a large and rapid circumferential rotation. In addition, by means of the shock-absorbing and torque-stabilizing device, the downhole auxiliary drilling apparatus can dampen the impact force through the compressed elastic member when the drilling bit comes into contact with the bottom of the wellbore. Therefore, the impact of axial vibration in the wellbore on the drilling bit can be reduced, and the drilling bit can be prevented from breaking or damage. Thus, the service time of the drilling tool can be significantly prolonged.

BRIEF DESCRIPTION OF THE DRAWINGS

In the following the present invention will be described with reference to the appending drawings, wherein.

All the drawings of the present invention are schematic, for purely illustrating the principle of the present invention. The drawings are not drawn based on actual scales.

DETAILED DESCRIPTION OF THE EMBODIMENTS

The present invention will be further described below in combination with the accompanying drawings.

Figure 1:
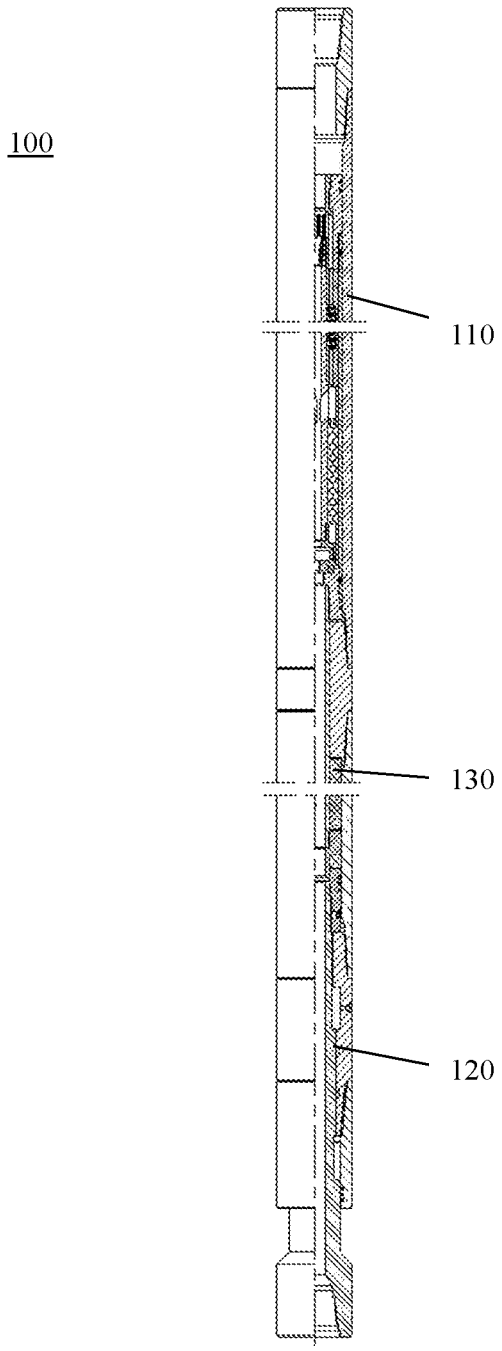
FIG. 1 shows the whole structure of a downhole auxiliary drilling apparatus according to an embodiment of the present invention.

FIG. 1 shows the structure of a downhole auxiliary drilling apparatus 100 in accordance with an embodiment of the present invention. As shown in FIG. 1, the downhole auxiliary drilling apparatus 100 includes an impact energy generator 110. The impact energy generator 110 is primarily used to convert the energy of the drilling fluid into axial impact energy. An impact energy distributor 120 is arranged at a lower end of the impact energy generator 110, and mainly used to redistribute the axial impact energy generated by the impact energy generator 110, so as to form combined impact energy consisting of axial impact energy and circumferential impact energy. Through the impact energy generator 110 and the impact energy distributor 120, the downhole auxiliary drilling apparatus 100 can provide the drilling bit with a high-frequently changing impact force in a combined direction, thereby effectively improving the working efficiency of the drilling tool. A shock-absorbing and torque-stabilizing device 130 is further arranged between the impact energy generator 110 and the impact energy distributor 120. During the drilling process, with the shock-absorbing and torque-stabilizing device 130, the axial vibration of the drilling tool can be reduced, the impact on the drilling bit can be alleviated, and the lifetime of the drilling bit can be effectively improved. Moreover, the shock-absorbing and torque-stabilizing device 130 can further automatically store and release the torque exceeding a prescribed limit value. When the stall occurs, the drilling bit can be moved axially to prevent the drilling bit, and the drilling tool as well, from rotating significantly in the circumferential direction.

In the present application, when the downhole auxiliary drilling apparatus 100 mounted on a drilling tool is disposed in a wellbore, an end thereof near the wellhead is defined as an upper end or the like, while an end thereof away from the wellhead is defined as a lower end or the like.

Figure 2:
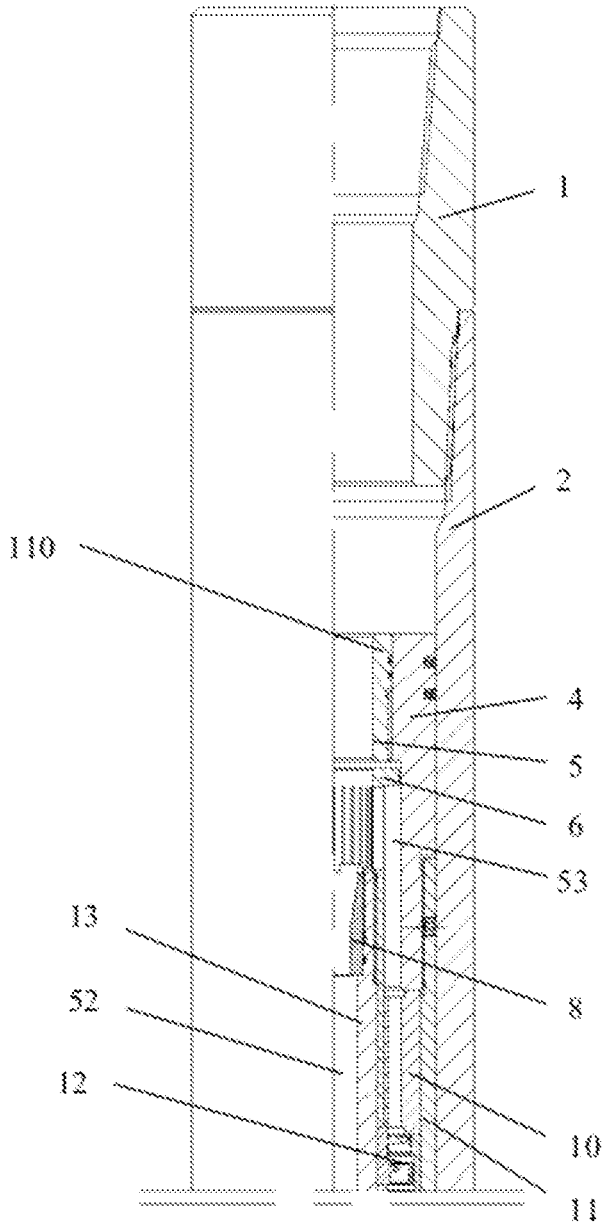
FIGS. 2 to 4 show the structure of different portions of the downhole auxiliary drilling apparatus of FIG. 1, respectively.

FIG. 2 shows the structure of the impact energy generator 110 of the downhole auxiliary drilling apparatus 100. As shown in FIG. 2, the impact energy generator 110 includes an outer casing 2 of a cylindrical shape. Each end of the outer casing 2 is formed as a tapered coupling. An upper joint 1 is connected to an upper end of the outer casing 2 by the tapered coupling. The downhole auxiliary drilling apparatus 100 is then connected to an upper drilling tool through the upper joint 1, and thus the installation operation is simple and quick.

Figure 3:
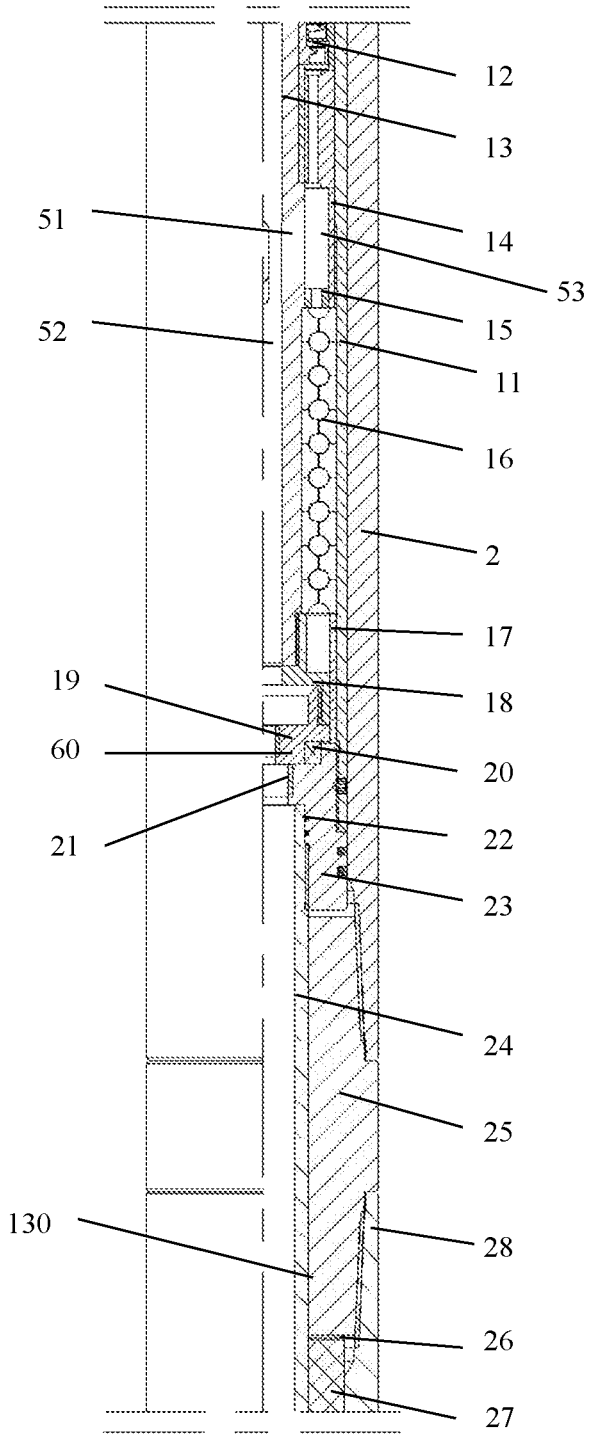

As shown in FIGS. 2 and 3, a drive shaft 13 is concentrically provided inside the outer casing 2. The center of the drive shaft 13 is provided with an internal passage 52, which extends in the axial direction, for flow of drilling fluid. A drilling fluid splitting mechanism is provided between the outer casing 2 and the drive shaft 13. The drilling fluid splitting mechanism includes a piston head that includes a first piston head 4 sealingly mounted on an inner wall of the outer casing 2, and a second piston head 5 mounted in and fixedly connected to the first piston head 4. In one embodiment, the first piston head 4 and the second piston head 5 are fixedly connected to each other through thread. The first piston head 4 and the second piston head 5 are both located upstream of the drive shaft 13. An O-ring seal may be provided between the first piston head 4 and the second piston head 5, in order to ensure the tightness therebetween.

In the present embodiment, a flow splitting member 6 is further arranged in the first piston head 4. As shown in FIG. 2, the flow splitting member 6 is configured as a sleeve member with a radial flange at one end thereof. A plurality of slits is provided in a circumferential side wall of the sleeve member. These slits are evenly distributed along the circumferential direction of the sleeve member. The flow splitting member 6 is fixedly mounted to an upstream end of the drive shaft 13. In one embodiment, an inner surface of a lower end of the flow splitting member 6 is threaded, so that the flow splitting member 6 is fixed to the upstream end of the drive shaft 13 through thread connection. A converging nozzle 8 is further arranged at the upstream end of the drive shaft 13 adjacent to the flow splitting member 6. Thus, when the drilling fluid from the upper drilling tool passes through the flow splitting member 6, a part of the drilling fluid (hereinafter referred to as a first drilling fluid) flows into the internal passage 52 of the drive shaft 13 directly through the converging nozzle 8, while another portion of the drilling fluid (hereinafter referred to as a second drilling fluid) enters an annular space 53 between the drive shaft 13 and the outer casing 2 through the slits in the side wall of the flow splitting member 6. In this manner, the drilling fluid can be separated into two flows. The flow of the second drilling fluid will be described in detail below.

In the present embodiment, an external thread is formed on an outer surface of the converging nozzle 8, whereby the converging nozzle 8 is fixed to the drive shaft 13 through thread connection. In order to ensure the tightness between the converging nozzle 8 and the drive shaft 13, in one embodiment, a seal groove is provided on an inner surface of the drive shaft 13 that is in contact with the converging nozzle 8, and an O-ring is mounted in the seal groove, thereby achieving a seal between the converging nozzle 8 and the drive shaft 13. The converging nozzle 8 can be made of erosion resistant material. In a preferred embodiment, the converging nozzle 8 is made of cemented carbide. In this way, not only the sealing performance between the converging nozzle 8 and the drive shaft 13 can be effectively ensured to enhance the effect of collecting the drilling fluid, but the converging nozzle can also have certain hardness, thereby improving the lifetime of the converging nozzle 8.

According to the present invention, the drilling fluid splitting mechanism further includes a force transmitting sleeve 11 mounted on the inner wall of the outer casing 2. As shown in FIG. 2, the force transmitting sleeve 11 is configured in a cylindrical shape. An upstream end of the force transmitting sleeve 11 is fixedly coupled to the first piston head 4. In one embodiment, an inner surface of each end of the force transmitting sleeve 11 is provided with thread. Therefore, the upstream end of the force transmitting sleeve 11 is screwed to the first piston head 4, and further fixed by a set screw. In this way, the stability between the force transmitting sleeve 11 and the first piston head 4 can be effectively ensured. A downstream end of the force transmission sleeve 11 is connected to a valve disc mechanism, which will be described in detail below.

As shown in FIGS. 2 and 3, a plurality of hydraulic motors is provided at the lower end of the first piston head 4. In the present embodiment, the hydraulic motor is specifically a turbine section 12. However, in other embodiments not shown, the hydraulic motor can be also a screw shaft, for example. According to the invention, the turbine section 12 is mounted on the drive shaft 13, and located within the force transmission sleeve 11. Each of the turbine sections 12 includes a stator and a rotor, wherein the stator is in close contact with the inner wall of the force transmitting sleeve 11, and the rotor is mounted to the drive shaft 13. The rotor is configured to be rotatable under the action of the drilling fluid (i.e., the second drilling fluid), so that the transmission shaft 13 can be rotated by the friction generated between the rotor and the transmission shaft 13. Rolling bearings 10 may be mounted on both the upper and lower ends of the plurality of turbine sections 12 for radial supporting and centering. An upper end surface of the rolling bearing mounted at the upper end of the turbine section 12 can abut against a lower end surface of the first piston head 4, thus providing axial positioning thereof. A number of turbine sections 12 are pressed by rolling bearings 10 arranged at two ends thereof, and the axial position of the turbine sections 12 can be adjusted by an adjustment ring 14 (shown in FIG. 3). In the present embodiment, the length of the adjustment ring 14 can be adjustable based on the actual fit size, so as to avoid machining errors. The stators are pressed together, and the rotors are pressed together, too. Thus, when the second drilling fluid flowing into the annular space 53 between the drive shaft 13 and the outer casing 2 from the flow splitting member 6 flows through the turbine section 12, the rotor will be rotated, and in turn drive the drive shaft 13 into rotation through the friction generated between the turbine section 12 and the drive shaft 13. Therefore, the drive shaft 13 can be rotated.

As shown in FIG. 3, the adjustment ring 14 is mounted at the downstream end of the rolling bearing, which is located at the lower end of the turbine section 12, for adjusting the axial position of the turbine section 12. Therefore, it is ensured that the turbine section 12 can effectively drive the drive shaft 13 into rotation. The adjustment ring 14 is arranged in the force transmission sleeve 11. A support sleeve 15 is arranged between the adjustment ring 14 and the drive shaft 13, for ensuring a radial space between the adjustment ring 14 and the drive shaft 13. Furthermore, a channel 51 is provided in a region of the drive shaft 13 corresponding to the adjustment ring 14, for guiding the second drilling fluid passing through the turbine section 12 into the internal passage 52 of the drive shaft 13. Thus, during operation, the second drilling fluid can continuously flow through the turbine section 12, thus ensuring continuous rotation of the turbine section 12.

According to the invention, a seat member 18 can also be mounted at the lower end of the drive shaft 13. In one embodiment, the seat member 18 is fixedly mounted to the drive shaft 13 through thread connection, so that it can be rotatable with the drive shaft 13. A plurality of thrust bearings 16 is mounted between the adjustment ring 14 and the seat member 18. The thrust bearings 16 are arranged on the drive shaft 13, and located between the drive shaft 13 and the force transmission sleeve 11, for bearing the axial load. In the present embodiment, a positioning sleeve 17 is provided between the seat member 18 and the outer casing 2.

As shown in FIG. 3, the drilling fluid splitting mechanism further includes a valve disc mechanism 60 mounted on the drive shaft 13. The valve disc mechanism 60 is disposed at the downstream end of the drive shaft 13, and located within the force transmission sleeve 11. The valve disc mechanism 60 includes a stationary valve disc 23, which is arranged on the inner walls of the outer casing 2 and the force transmitting sleeve 11. The stationary valve disc 23 is fixedly connected to the force transmitting sleeve 11, and thus remains stationary. In one embodiment, the stationary valve disc 23 is coupled to the force transmitting sleeve 11 through thread, and further fixed thereto with a set screw arranged between the stationary valve disc 23 and the force transmitting sleeve 11. In order to ensure the tightness between the stationary valve disc 23 and the force transmitting sleeve 11, in one embodiment, an outer surface of the lower end of the stationary valve disc 23 is provided with a sealing groove, in which a GLYD ring is arranged for sealing. Moreover, an anti-wear sleeve 21 may also be mounted on the inner surface of the stationary valve disc 23 through an interference fit.

Figure 5:
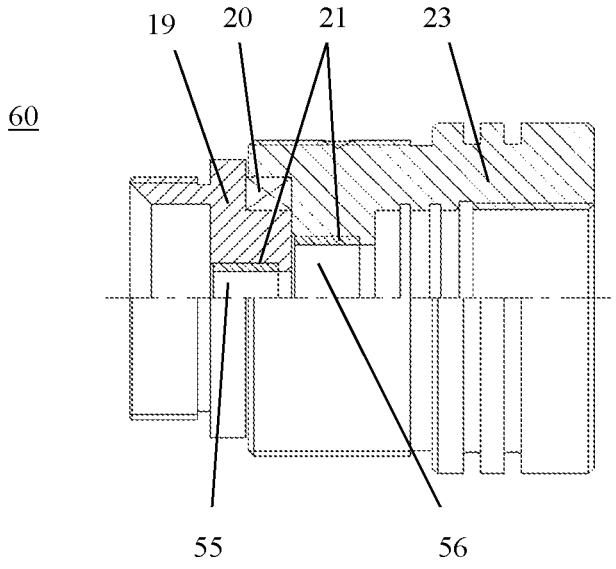
FIG. 5 shows the structure of a valve disc mechanism used in the downhole auxiliary drilling apparatus as shown in FIG. 1 of the present invention.

FIG. 5 shows the specific structure of the valve disc mechanism 60. As shown in FIG. 5, in one embodiment, the inner surface of the lower end of the stationary valve disc 23 is provided with threads, for connection to a corresponding downstream component. At the same time, an O-ring seal may be provided between the stationary valve disc 23 and the downstream component to form a seal. A first hole 56 is formed in the stationary valve disc 23.

In the present embodiment, a movable valve disc 19 is arranged at an upper end (the left end in FIG. 3) of the stationary valve disc 23, for example, via a bearing 20. The movable valve disc 19 is fixedly coupled to the seat member 18, so as to form a fixed connection with the drive shaft 13. In one embodiment, the movable valve disc 19 is coupled to the seat member 18 through thread. An anti-wear sleeve 21 may also be mounted on an inner surface of the movable valve disc 19 by an interference fit. In the present embodiment, a second hole 55 is provided in the movable valve disc 19. According to the present invention, the first hole 56 and the second hole 55 form an eccentric relationship with each other, although not explicitly shown in FIG. 5.

According to the present invention, since the stationary valve disc 23 is fixed and thus does not rotate while the movable valve disc 19 is driven into rotation by the drive shaft 13, and the first hole 56 of the stationary valve disc 23 and the second hole 55 of the movable valve disc 19 are eccentric related to each other, the flow area of the valve disc mechanism 60 will change periodically as the movable valve disc 19 rotates. This will cause the pressure above the moving valve disc 19 to be constantly changing. This pressure applies on the piston head to create a periodically changing pressure, which is ultimately transmitted to a drilling bit installed downstream of the downhole auxiliary drilling apparatus 100. Therefore, the drilling bit is exerted with a high-frequent combined impact force, in addition to conventional pressure and torque, thus greatly improving the rock breaking efficiency of the drilling tool. Further, the force is changed at a high frequency, and the frequency thereof depends on the frequency of rotation of the turbine section 12, while the magnitude of the change thereof depends on the magnitude of the change of the flow area between the movable valve disc 19 and the stationary valve disc 23. The force, with the cooperation of an energy distribution mechanism which will be described later, enables the drilling tool to have an combined (i.e., axial and circumferential) impact force, which effectively improves the combined drilling performance of the drilling tool, and greatly increases the drilling effectiveness of the drilling tool.

Figure 4:
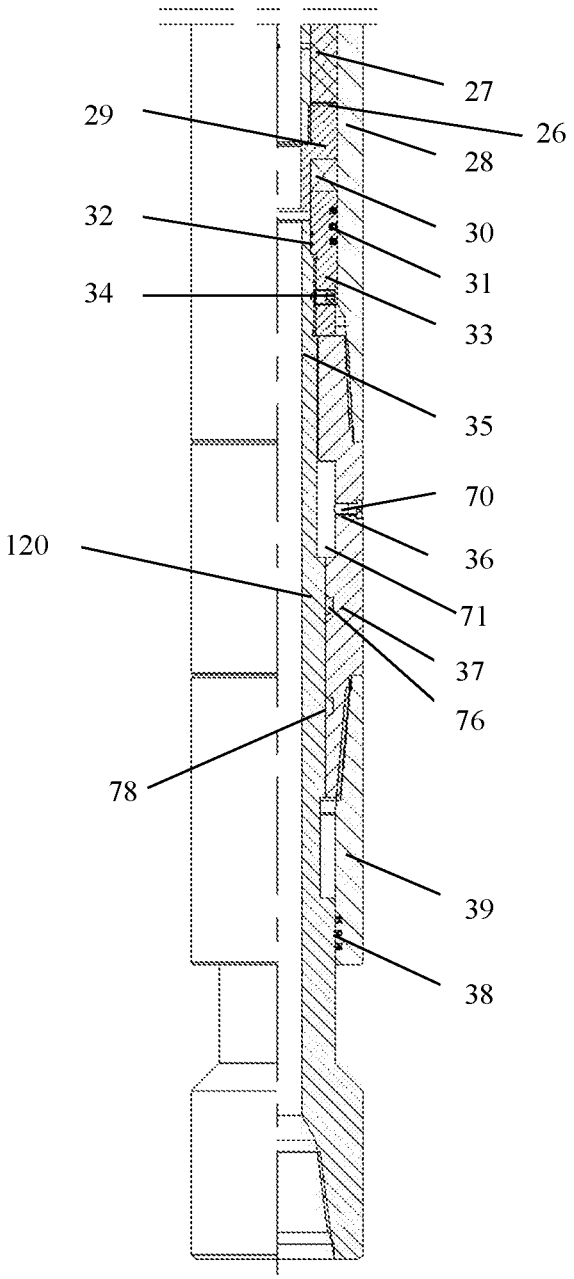

The downhole auxiliary drilling apparatus 100 according to the present invention further includes a shock-absorbing and torque-stabilizing device 130. As shown in FIGS. 3 and 4, the shock-absorbing and torque-stabilizing device 130 is arranged at the downstream end of the impact energy generator 110. The shock-absorbing and torque-stabilizing device 130 includes a spring cylinder 28, which is configured in a cylindrical shape, and provided with a tapered coupling at each end thereof. A tubular spring inner sleeve 24 is concentrically arranged within the spring cylinder 28, and an upper end of the spring inner sleeve 24 is fixedly coupled to the stationary valve disc 23. In one embodiment, the spring inner sleeve 24 is fixedly coupled to the stationary valve disc 23 through threads. At the same time, a plurality of O-rings 22 is provided between the spring inner sleeve 24 and the stationary valve disc 23, in order to form a seal between the spring inner sleeve 24 and the stationary valve disc 23.

In the present embodiment, an elastic member 27 is arranged in an annular space formed between the spring cylinder 28 and the spring inner sleeve 24. The elastic member 27 is capable of expanding and contracting along the axial direction, thereby releasing the axial impact of the drilling tool and also storing the released energy. A first limiting member 25 and a second limiting member 29 are respectively disposed at two ends of the elastic member 27, with a spacer is respectively arranged between the elastic member 27 and the first limiting member 25, and between the elastic member 27 and the second limiting member 29. The spacer 26 is used to adjust the initial preload of the elastic member 27.

As shown in FIG. 3, the first limiting member 25 is configured in a cylindrical shape, and each end thereof is provided with a tapered coupling. The first limiting member 25 is mounted on the spring inner sleeve 24, and located between the outer casing 2 and the spring cylinder 28. The tapered couplings at both ends of the first limiting member 25 are respectively engaged with the tapered couplings of the outer casing 2 and the spring cylinder 28, so as to form fixed connections. The upper end of the elastic member 27 abuts against the lower end surface of the first limiting member 25, thereby forming a limit to the elastic member 27. As shown in FIG. 5, the second limiting member 29 is fixedly mounted to the lower end of the spring inner sleeve 24. In one embodiment, the second limiting member 29 is coupled to the spring inner sleeve 24 through threads. Moreover, the elastic member 27 also abuts against the upper end of the second stopper 29, thereby forming a limit to the elastic member 27.

When the drilling bit is subjected to an instantaneous impact of the formation, the elastic member 27 will be compressed, and thus the impact energy will be converted into the elastic potential energy of the elastic member 27 and stored therein. At this point, the drilling bit will be gradually lifted from the bottom of the wellbore, until the drilling bit returns to its original rotational speed. When the torque of the drilling bit is reduced, the energy stored in the elastic member 27 will be released, thus maintaining the drilling bit to drill properly. The compressed elastic member 27 can provide buffering effect to the impact force. In this manner, the downhole auxiliary drilling apparatus 100 can automatically store and release the torque exceeding a limit value through the elastic member 27. Therefore, the vibration of the drilling tool can be effectively reduced, the damage of the drilling bit can be avoided, and the lifetime of the drilling bit can be prolonged.

FIG. 4 shows the structure of the impact energy distributor 120 of the downhole auxiliary drilling apparatus 100. As shown in FIG. 4, the impact energy distributor 120 is arranged at the downstream end of the shock-absorbing and torque-stabilizing device 130. The impact energy distributor 120 includes a hollow mandrel 35. A mandrel bushing 33 is fixedly coupled to an upper end of the mandrel 35 by a thread and a set screw 34, and a lower end of the mandrel 35 is used to connect a lower drilling tool, such as a drilling bit (not shown). The mandrel bushing 33 is sealingly coupled to the mandrel 35 and the inner surface of the spring barrel 28, respectively. In one embodiment, a plurality of O-rings 32 is provided between the mandrel bushing 33 and the mandrel 35, and a plurality of GLYD rings 31 is mounted between the mandrel bushing 33 and an inner surface at the lower end of the spring cylinder 28. In this manner, a sealing connection is formed between the mandrel bushing 33 and the mandrel 35, and also between the mandrel bushing 33 and the spring cylinder 28. Further, in order to reduce the friction between the second limiting member 29 and the mandrel bushing 33 and reduce the resistance therebetween, a bearing 30 is arranged between the second limiting member 29 and the mandrel bushing 33.

According to the present invention, the impact energy distributor 120 further includes a compression-torsion housing 37. As shown in FIG. 4, the compression-torsion housing 37 is configured in a cylindrical shape, with each end thereof being formed as a tapered coupling. The compression-torsion housing 37 is mounted on the mandrel 35 in such a manner that the tapered coupling at the upper end of the compression-torsion housing 37 cooperates with the tapered coupling at the lower end of the spring cylinder 28 to form a fixed connection. An inner spiral groove 76 is provided on an inner surface of the compression-torsion housing 37, and an outer spiral 78, which is engageable with the inner spiral groove 76 of the compression-torsion housing 37, is provided on the mandrel 35. With such a helical fit between the outer spiral 78 of the mandrel 35 and the inner helical groove 76 of the compression-torsion housing 37, the axial impact force exerted on the mandrel 35 can be converted into a combined impact force. When the drilling tool is stalled, the downhole auxiliary drilling apparatus 100 can axially move the drilling bit through the helical pair, thereby preventing a large and rapid circumferential rotation thereof. Therefore, the drilling bit can be effectively prevented from being damaged, the damages on the downhole drilling tool and the measurement while drilling instrument can be reduced, and the lifetime of the drilling tool can be prolonged.

In the present embodiment, a radially outward annular groove 71 is provided on the inner surface of the compression-torsion housing 37. A through hole 70 is provided in a region of the side wall of the compression-torsion housing 37 where the annular groove 71 is located. Through the through hole 70, lubricant, such as lubricating oil or grease, or the like, can be injected into a gap formed between the compression-torsion housing 37 and the mandrel 35. A screw plug 36 may be arranged in the through hole 70 to form a seal. In this way, the spiral engagement between the mandrel 35 and the compression-torsion housing 37 and the lubrication therebetween can be both effectively ensured, so that the movement of these components is facilitated, and the lifetime of the downhole auxiliary drilling apparatus 100 is significantly improved.

As shown in FIG. 4, a sealing member 39 may be provided at the lower end of the compression-torsion housing 37. The sealing member 39 is mounted on the mandrel 35. The sealing member 39 is configured as a hollow cylinder, with a tapered coupling provided inside the upper end of the sealing member 39. The tapered coupling of the sealing member 39 is in engagement with the tapered coupling arranged at the lower end of the compression-torsion housing 37, and thus is fixedly connected thereto through threads. In one embodiment, a plurality of GLYD rings 38 is provided between the sealing member 39 and the mandrel 35, so as to form a seal between the mandrel 35 and the sealing member 39.

In the following the principle of operation of the downhole auxiliary drilling apparatus 100 in accordance with the present invention will be briefly described. In practical use, the downhole auxiliary drilling apparatus 100 is mounted on a drill string of a drilling tool which is adjacent to the drilling bit. During drilling operation, when the drilling bit contacts the bottom of the wellbore, the drilling bit will be subjected to an upward impact force given by the formation. At this time, the mandrel 35 of the downhole auxiliary drilling apparatus 100 moves upwardly by means of the helical pair between the mandrel 35 and the compression-torsion housing 37. Therefore, the entire drilling tool is in a compressed state, so that the entire drilling string is shortened. In addition, the compressed elastic member 27 will convert the impact energy into the elastic potential energy of the elastic member 27, which is stored in the elastic member 27, thereby buffering the impact force applied to the drilling bit. When the drilling tool is in a state of stick-and-slip, the drilling bit will be subjected to a torque exceeding a set value. At this time, under the action of the helical pair between the mandrel 35 and the compression-torsion housing 37, the compressed elastic member 27 drives the drilling bit to move up, until the drilling bit returns to its original rotational speed. When the torque of the drilling bit is reduced, the energy stored in the elastic member 27 will be released, so that the mandrel 35 will be pushed by the second limiting member 29 and the mandrel bushing 33, and thus moved downwardly through the helical pair between the mandrel 35 and the compression-torsion housing 37. Therefore, the torque energy can be released, so as to keep the drilling bit drilling properly.

At the same time, the drilling fluid passes through the interior of the drilling tool during normal drilling. When the drilling fluid flows through the flow splitting member 6, a part of the drilling fluid continues to flow downwardly through the converging nozzle 8 along the internal passage 52 of the drive shaft 13, while the other part thereof flows through the slits formed in the side wall of the flow splitting member 6 into the annular space between the first piston head 4 and the flow splitting member 6, and then flows through the rolling bearings 10 and the turbine section 12. When the drilling fluid flows through the turbine section 12, the turbine rotor will be driven into rotation. The turbine rotor then drives the drive shaft 13 into rotation by friction, thereby driving the seat member 18 and the movable valve disc 19 into rotation. Since the stationary valve disc 23 does not rotate, and the holes of the movable valve disc 19 and the stationary valve disc 23 are eccentric with each other, the flow area between the movable valve disc 19 and the stationary valve disc 23 will be changed periodically as the movable valve disc 19 rotates. This will cause the pressure above the moving valve disc 19 to be constantly changing. This pressure applies on the piston head to create a periodically varying pressure. The pressure is changed at a high frequency, and the frequency thereof depends on the frequency of rotation of the turbine section 12, while the magnitude of the change thereof depends on the magnitude of the change of the flow area between the movable valve disc 19 and the stationary valve disc 23. In this manner, the high-frequently changing force is transmitted to the mandrel 35 through the first piston head 4, the force transmitting sleeve 11, the stationary valve disc 23, the spring inner sleeve 24, the second limiting member 29, and the mandrel bushing 33. Due to the helical fit between the mandrel 35 and the compression-torsion housing 37, the direction of the force is changed to the direction of the helix angle of the helix fit, and finally transmitted to the drilling bit arranged downstream of the downhole auxiliary drilling apparatus 100. Therefore, the drilling bit will be exerted with a high-frequent combined impact force, in addition to the conventional pressure and torque, thus greatly improving the rock breaking efficiency and the rate of penetration of the drilling tool.

The downhole auxiliary drilling apparatus 100 according to the present invention realizes the conversion of the energy of the drilling fluid to the axial impact energy through providing the impact energy generator 110, and redistributes the impact energy through the impact energy distributor 120 to convert the axial impact force into a combined impact force, which provides the drilling bit with a high-frequently changing combined (i.e., axial and circumferential) impact force, which greatly improves the rock breaking efficiency and the rate of penetration of the drilling tool. At the same time, the downhole auxiliary drilling apparatus 100 is further provided with the shock-absorbing and torque-stabilizing device 130, so that the impact force generated when the drilling bit of the drilling tool contacts the bottom of the wellbore can be buffered by the compression of the elastic member 27. When the drill is stalled, the drilling bit can be axially moved through the helical pair of the impact energy distributor 120, and thus effectively prevented from a large and rapid circumferential rotation. In this way, it can effectively prevent the damage of the drilling bit, avoid the torsional vibration of the drilling tool, prevent the drilling bit from breaking, effectively reduce the axial vibration of the drilling tool, greatly extend the lifetime of the drilling bit, and reduce the damages of the downhole drilling tool and the drilling measuring instrument. Thus the service time of the drilling tool can be significantly prolonged. At the same time, the elastic member 27 can automatically store and release the torque exceeding the set value during the drilling operation, so that the downhole auxiliary drilling apparatus 100 can function excellently in terms of stabilizing the torque.

Figure 6:
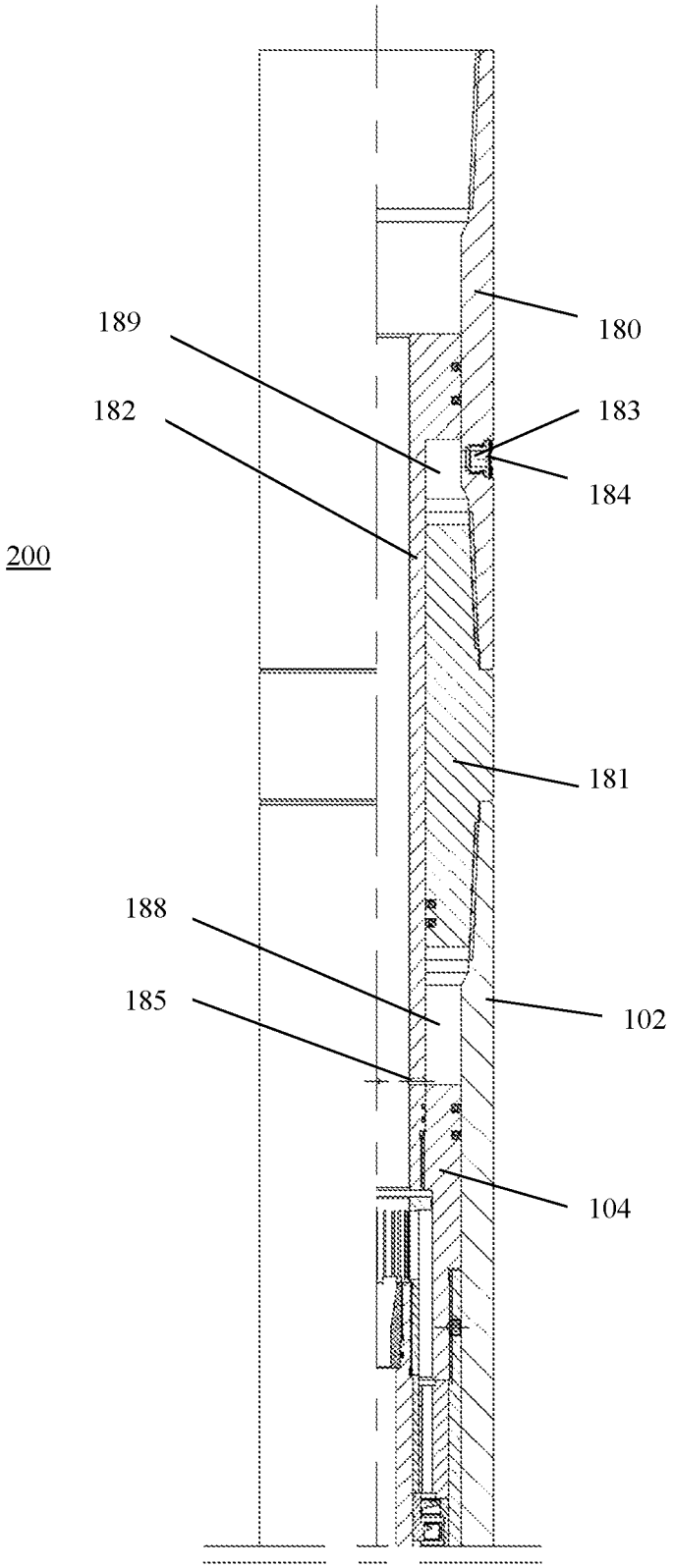
FIG. 6 shows the structure of a portion of a downhole auxiliary drilling apparatus, which corresponds to that shown in FIG. 2, according to another embodiment of the present invention.

The present invention further provides a downhole auxiliary drilling apparatus 200 according to another embodiment. The structure of the downhole auxiliary drilling apparatus 200 is substantially the same as that of the above-described downhole auxiliary drilling apparatus 100, except for an upper portion of the downhole auxiliary drilling apparatus, i.e., the portion as shown in FIG. 6. Other portions of the downhole auxiliary drilling apparatus 200 are the same as those in the above-described downhole auxiliary drilling apparatus 100 respectively, and therefore, detailed description thereof and related drawings are omitted here for the sake of conciseness. For ease of understanding, the reference numbers in FIG. 6 are those in FIG. 2 (if any) plus 100, respectively.

As shown in FIG. 6, the downhole auxiliary drilling apparatus 200 includes a cylindrical casing 102, each end thereof being configured as a tapered coupling. A cylinder 180, which is provided with a tapered coupling at each end thereof, is arranged at an upstream end of the casing 102. A middle joint 181 is arranged between the cylinder 180 and the casing 102. The middle joint 181 is configured in a cylindrical shape, each end thereof being configured as a tapered coupling. The tapered couplings of the middle joint 181 are coupled to those of the cylinder 180 and the casing 102, so that the cylinder 180 and the casing 102 are fixedly connected with each other. An upper joint (not shown) is connected to an upper end of the cylinder 180 through the tapered coupling. The downhole auxiliary drilling apparatus 200 is coupled to the upper drilling tool through the upper joint.

As shown in FIG. 6, a piston 182 is arranged inside the cylinder 180 and the middle joint 181. The piston 182 is configured as a hollow shaft having an end with a flange. A GLYD ring may be placed between the side of the flange and the inner wall of the cylinder 180 to form a seal between the flange and the cylinder 180. Of course, other sealing members can also be used, such as V-rings, combined seals, and the like. The middle joint 181 is mounted on the piston 182. In addition, a GLYD ring is mounted between the middle joint 181 and the piston 182 to form a seal therebetween. Thus, a closed second annular space 189 is defined by the cylinder 180, the piston 182, and the middle joint 181.

In the present embodiment, a second through hole 183 is provided in the side wall of the cylinder 180 which is located in the second annular space 189. A threaded groove (not shown) is machined in the second through hole 183, and provided therein with a sand control gasket, a sand control nut 184 and a hole circlip along a direction from inside to outside. The sand control gasket is provided with a filter screen, so that the drilling fluid can pass through the sand control gasket, but large solid phase particles in the drilling fluid can be filtered out through the filter screen. The sand control nut 184 is threaded onto the cylinder 180 to press against the sand control pad. The hole circlip is mounted on the sand control nut 180, and is placed in the groove to prevent loosening of the connection between the cylinder 180 and the sand control nut 184, thereby preventing the sand control gasket and the sand control nut 184 from falling off. By arranging the sand control gasket, the sand control nut 184, and the hole circlip, the closed space formed between the cylinder 180, the piston 182, and the middle joint 181 can be in communication with an annular space out of the drilling tool, and the drilling fluid in the closed space can flow to and from said annular space through the sand control gasket, the sand control nut 184, and the hole circlip.

In the present embodiment, the pressure at the upper end of the piston 182 is the pressure inside the drilling tool, while the pressure in the second annular space 189 defined by the cylinder 180, the piston 182 and the middle joint 181 is the pressure of the annular space out of the drilling tool. The pressure inside the drilling tool is greater than the pressure outside the drilling tool, thus creating a pressure difference. In addition, the pressure inside the drilling tool changes periodically. Therefore, a cyclically changing axial impact force is generated. As a result, the piston 182 is subjected to a downward force, thereby increasing the impact force of the drilling bit, which further improves the drilling efficiency of the drilling tool.

In this embodiment, the drilling fluid splitting mechanism includes a piston head 104, which is disposed upstream of the drive shaft (not shown). The interior of the piston head 104 can be threaded. At the same time, an external thread is provided at the downstream end of the piston 182, so that the piston head 104 and the piston 182 are fixedly connected with each other by threads. An O-ring seal is provided between the piston head 104 and the piston 182 to ensure a seal between the piston head 104 and the piston 182. At the same time, a GLYD ring can also be mounted between the piston head 104 and the casing 102, in order to form a seal between the piston head 104 and the casing 102. Further, the casing 102 is fixedly coupled to the middle joint 181. Thus, the middle joint 181 and the piston head 104 together define a closed first annular space 188 between the casing 102 and the piston 182.

In the present embodiment, a first through hole 185 is provided in a region of the side wall of the piston 182 which is located in the first annular space 188. As shown in FIG. 6, the first through hole 185 communicates a central flow path of the piston 182 with the first annular space 188 with each other. Thus, the pressure inside the piston 182 can be transmitted to the upper end surface of the piston head 104 through the first through hole 185. Due to the periodic change of the pressure within the drilling tool, a cyclically changing axial impact force can be generated. Therefore, this structure further increases the axial impact force of the drilling bit, thereby improving the drilling efficiency of the drilling tool.

During normal drilling of the downhole auxiliary drilling apparatus 200, the drilling fluid within the drilling tool exists beyond the upper end surface of the piston 182, while the drilling fluid within the annular space out of the drilling tool exists in the second annular space 189 defined by the piston 182, the middle joint 181 and the cylinder 180. The pressures of the two drilling fluids are different. Specifically, the pressure of the drilling fluid in the drilling tool is greater than that of the drilling fluid in the annular space out of the drilling tool, thus creating a pressure difference. Therefore, under the action of the pressure difference, the piston 182 is subjected a force which is continuously oriented downwardly. This force can be transmitted to the mandrel through the piston 182, the piston head 104, the force transmission sleeve and other components, and then transmitted to the drilling bit or the lower drilling tool. In this way, the axial impact force and the combined impact force of the drilling bit are further enhanced, thereby significantly improving the drilling efficiency of the drilling tool.

Although various components of the downhole auxiliary drilling apparatus in accordance with the present invention have been described in detail above, it should be understood that not all the components are necessary. Rather, some of the components may be omitted, as long as the corresponding functions of the downhole auxiliary drilling apparatus in accordance with the present invention would not be affected.

Although the present invention has been described in detail with reference to preferred embodiments, under the premise of not departing from the scope of the present invention, various improvements can be made to the present invention, and equivalents can be used to replace parts in the present invention. In particular, as long as no structural conflict exists, various technical features mentioned in each embodiment can be combined in any arbitrary manner. The present invention is not limited to the specific embodiments disclosed herein, but contains all the technical solutions falling within the scope of the claims.

The invention claimed is:

1. A downhole auxiliary drilling apparatus, comprising:

an impact energy generator and an impact energy distributor disposed on a distal side of the impact energy generator, wherein the impact energy generator comprises:

a cylindrical casing;

a hollow drive shaft concentrically arranged in the casing;

a valve disc mechanism disposed about the drive shaft, wherein the valve disc mechanism comprises a stationary valve disc and a movable valve disc, the movable valve disc being configured to be driven into rotation by the drive shaft; and a drilling fluid splitting mechanism disposed between the casing and the drive shaft, wherein the drilling fluid splitting mechanism comprises a piston head sealingly disposed on an inner wall of the casing, a flow splitting member disposed inside the piston head, a force transmission sleeve disposed in the casing, and at least one hydraulic motor disposed on a distal side of the piston head and inside the force transmission sleeve, wherein the flow splitting member is configured to allow a first portion of a drilling fluid to flow through the flow splitting member into an internal passage of the drive shaft and a second portion of the drilling fluid flows into the internal passage via the at least one hydraulic motor, which is configured to drive the drive shaft into rotation, and both a first end and a second end of the force transmission sleeve are fixedly connected to the piston head and the stationary valve disc, respectively, wherein the impact energy distributor comprises:

a hollow mandrel having a first end connected to the stationary valve disc and a second end configured to connect a drilling tool; and a compression-torsion housing connected to a distal end of the casing and forms a helix fit with the mandrel so as to convert an axial impact force exerted on the mandrel into a combined impact force.

2. The downhole auxiliary drilling apparatus according to claim 1, wherein the flow splitting member comprises a sleeve member and a radial flange affixed to one end of the sleeve member, wherein a circumferential wall of the sleeve member is provided with a plurality of slits configured to allow the second portion of the drilling fluid to flow into the hydraulic motor.

3. The downhole auxiliary drilling apparatus according to claim 2, wherein the flow splitting member is affixed to a proximal end of the drive shaft, and a converging nozzle is disposed at a position in the drive shaft adjacent to the flow splitting member.

4. The downhole auxiliary drilling apparatus according to claim 1, wherein the hydraulic motor comprises as a turbine section having a stator and a rotor, wherein the rotor is configured to be rotated by the second portion of the drilling fluid so as to drive the drive shaft into rotation.

5. The downhole auxiliary drilling apparatus according to claim 4, wherein an adjustment ring is disposed in the force transmission sleeve at a position distal to the turbine section, and a channel is arranged in a section of the drive shaft adjacent to the adjustment ring for guiding the second portion of the drilling fluid flowing through the turbine section to the internal passage of the drive shaft.

6. The downhole auxiliary drilling apparatus according to claim 5, further comprises a plurality of thrust bearings disposed between the adjustment ring and the movable valve disc.

7. The downhole auxiliary drilling apparatus according to claim 1, wherein the movable valve disc comprises an eccentric hole so that a flowing area of the valve disc mechanism is configured to change as the movable valve disc moves.

8. The downhole auxiliary drilling apparatus according to claim 7, wherein the movable valve disc is affixed to the drive shaft through a seat member, and is mounted on the stationary valve disc via a first bearing.

9. The downhole auxiliary drilling apparatus according to claim 1, further comprising a cylinder fixedly connected to a proximal end of the casing through a middle joint, wherein a piston is disposed in the cylinder and is fixedly connected to the piston head.

10. The downhole auxiliary drilling apparatus according to claim 9, wherein the middle joint and the piston head together define a closed first annular space between the casing and the piston, wherein a first through hole is disposed in a side wall of the piston and has an opening to the first annular space.

11. The downhole auxiliary drilling apparatus according to claim 10, wherein the cylinder, the piston, and the middle joint together define a closed second annular space, wherein a second through hole is disposed in a side wall of the cylinder and has an opening to the second annular space.

12. The downhole auxiliary drilling apparatus according to claim 1, further comprises a shock-absorbing and torque-stabilizing device arranged between the impact energy generator and the impact energy distributor.

13. The downhole auxiliary drilling apparatus according to claim 12, wherein the shock-absorbing and torque-stabilizing device comprises: a spring cylinder having a first end affixed to the casing and a second end affixed to the compression-torsion housing; and a spring inner sleeve arranged in the spring cylinder, wherein a first end of the spring inner sleeve is connected to the stationary valve disc and a second end of the spring inner sleeve is connected to the mandrel, wherein at least one elastic member is arranged between the spring cylinder and the spring inner sleeve.

14. The downhole auxiliary drilling apparatus according to claim 13, wherein a first limiting member is disposed at a proximal end of the elastic member and a second limiting member is disposed at a distal end of the elastic member, and wherein the spring inner sleeve is connected to the mandrel via the second limiting member.

15. The downhole auxiliary drilling apparatus according to claim 14, wherein a first spacer is disposed between the elastic member and the first limiting member, and a second spacer is disposed between the elastic member and the second limiting member for adjusting preload of the elastic member.

16. The downhole auxiliary drilling apparatus according to claim 15, wherein the spring inner sleeve is fixedly connected to the second limiting member, and a mandrel bushing is disposed at a proximal portion of the mandrel and is in contact with the second limiting member via a second bearing.

17. The downhole auxiliary drilling apparatus according to claim 1, wherein the mandrel has an outer helix, and the compression-torsion housing has an inner helix engageable with the outer helix, and a through hole for injecting a lubricant.

* * * * *